US005586565A

United States Patent [19]

Babey et al.

[11] Patent Number: 5,586,565

[45] Date of Patent: Dec. 24, 1996

[54] METHOD FOR VARYING TOBACCO ROD DENSITY AND TOBACCO RODS WITH VARYING DENSITY PRODUCED THEREBY

[75] Inventors: Jacques Babey, Pully; Brian Salmon, St-Legier; Eric De Borst, Belmont; Bernard Tallier, Cortaillod, all of Switzerland

[73] Assignee: Philip Morris Incorporated, New York, N.Y.

[21] Appl. No.: 575,108

[22] Filed: Dec. 19, 1995

Related U.S. Application Data

[62] Division of Ser. No. 259,718, Jun. 14, 1994, Pat. No. 5,501,233.

[30] Foreign Application Priority Data

Jun. 16, 1993 [EP] European Pat. Off. ..... 93810432

[51] Int. Cl.[6] ..... A24C 5/14

[52] U.S. Cl. ..... 131/84.2; 131/84.4

[58] Field of Search ..... 131/84.1, 84.2, 131/84.4

[56] References Cited

U.S. PATENT DOCUMENTS 5,003,996 4/1991 Tallier et al. ..... 131/84.2

FOREIGN PATENT DOCUMENTS 528836 8/1956 Canada ..... 131/84.2

689590 4/1953 United Kingdom ..... 131/84.2

*Primary Examiner*—Jennifer Bahr

*Attorney, Agent, or Firm*—James T. Moore; James E. Schardt; Charles E. B. Glenn

[57] ABSTRACT

A cam is provided having one or more end blades, each having a respective support surface to compress a corresponding end region of a tobacco rod, and one or more interposed blades, each having a respective support surface to comprise a corresponding intermediate region(s) between the end region(s) as the cam rotates. The lengths of the blades are varied to proportionately vary the density of the regions and the widths and thicknesses of the support surfaces are varied to proportionately vary the width and length of the regions. A tobacco rod, and ultimately a cigarette, is produced having intermediate compressed regions between compressed end regions.

50 Claims, 3 Drawing Sheets

METHOD FOR VARYING TOBACCO ROD DENSITY AND TOBACCO RODS WITH VARYING DENSITY PRODUCED THEREBY

This is a divisional of our application Ser. No. 08/259,718, filed Jun. 14, 1994, now U.S. Pat. No. 5,501,233.

PRIORITY APPLICATION

The present application claims priority from European patent application 93810432.0, filed Jun. 16, 1993, which is hereby incorporated by reference.

BACKGROUND OF THE INVENTION

1. Technical Field of the Invention

The present invention relates to a method and apparatus for varying the tobacco density over the length of a tobacco rod product such as a cigarette.

2. Discussion of the Related Art

A cigarette may be produced composed wholly or in part of expanded shreds of tobacco and/or of expanded ribs of tobacco. These ingredients are present in the form of small shreds which are more difficult to work than the usual long shreds of leaf tobacco. A cigarette of this type, obtained by a usual manufacturing process, will have a low value of filling density, i.e., a poor maintenance of tobacco in the cigarette. If, in order to increase this filling density to a favorable value, the tobacco is squeezed more or its cramming is increased, a cigarette is obtained having modified characteristics such as resistance to draw or yield.

The problems mentioned above are the same when the cigarette includes a certain proportion of non-expanded short shreds of tobacco. These short shreds are either chosen to form part of a particular mixture of tobacco or result from damaging the shreds of tobacco at the time of the earlier preparation operations.

The compactness of the finished product is checked by a compressibility-measurement apparatus as described in European patent EP-A-0,195,173.

Objects of the Invention

An object of the present invention is to provide a method and apparatus to obtain improved filling of a tobacco product such as a cigarette made up wholly or in part of raw materials of the tobacco industry other than long shreds of tobacco, i.e., starting from expanded shreds and/or ribs of tobacco or from short shreds, which has a desired compactness, which is pleasant to smoke, and which does not necessitate an excessive effort of inhalation.

Another object of the invention is to provide a tobacco product such as a cigarette of better quality, made up wholly or in part starting from expanded shreds and/or ribs of tobacco or from short shreds, which has an improved filling and favorable compactness, which is pleasant to smoke, and which does not necessitate an excessive effort of inhalation.

SUMMARY OF THE INVENTION

The foregoing and additional objects are obtained by the present invention. A cam is provided having one or more end blades, each having a respective support surface to compress a corresponding end region of a tobacco rod, and one or more interposed blades, each having a respective support surface to compress a corresponding intermediate region(s) between the end region(s) as the cam rotates. The lengths of the blades are varied to proportionately vary the density of the regions and the widths and thicknesses of the support surfaces are varied to proportionately vary the width and length of the regions. A tobacco rod, and ultimately a cigarette, is produced having intermediate compressed regions between compressed end regions.

BRIEF DESCRIPTION OF THE DRAWINGS

The invention is explained in more detail below, vis-à-vis the enclosed drawing comprising the figures where.

DETAILED DESCRIPTION OF THE PREFERRED EMBODIMENTS

European application EP-A-0,354,874, which corresponds to U.S. Pat. No. 5,003,996 to Tallier et al., describes a device for trimming a rod of tobacco during manufacture. This trimming device is preceded by a device according to the present invention permitting a portion of the length of the rod to be compressed in order to increase the tobacco density thereof. These higher-density portions correspond to the ends and optionally other portions of the cigarettes, thus avoiding losing shreds of tobacco at the ends and varying the density elsewhere.

Figure 1:
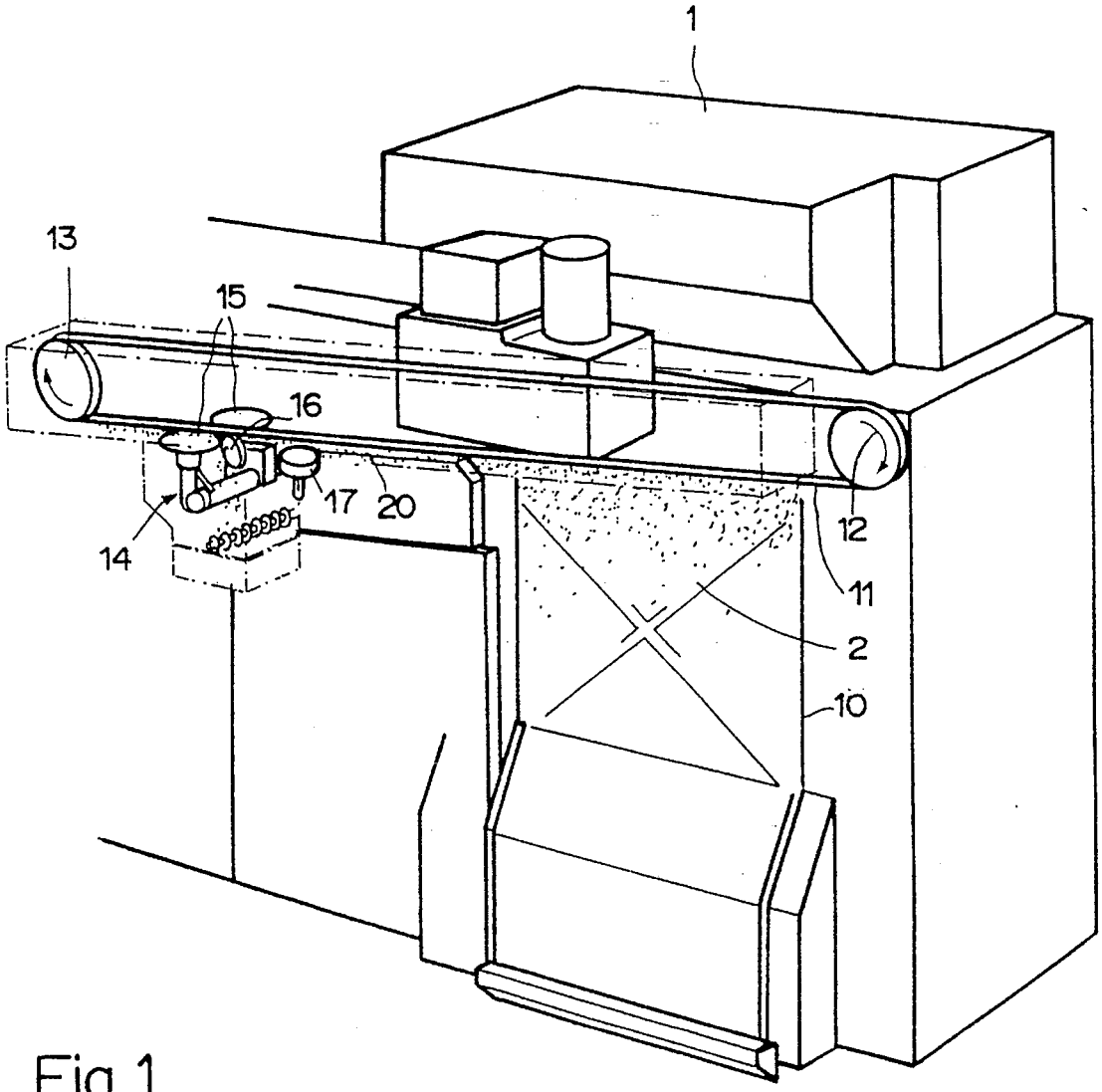
FIG. 1 is a perspective view of a portion of a cigarette manufacturing machine.

In FIG. 1 there is a diagrammatic perspective representation of a downstream portion of a conventional cigarette manufacturing machine 1 of known type. Cigarette manufacturing machine 1 includes in particular a tub 10 containing tobacco or other raw materials 2. As discussed, tobacco or other raw materials 2 can be comprised wholly or in part of expanded shreds of tobacco and/or of expanded ribs of tobacco which are shorter than normal tobacco shreds. In addition or alternatively, the tobacco or other raw materials 2 can include short shreds chosen for the mixture or resulting from damage. Cigarette manufacturing machine 1 further includes a porous belt 11 driven with a longitudinal movement by two pulleys 12 and 13. A negative pressure is created on the upper part of the lower length of the porous belt 11 in order to draw the shreds of tobacco 2 out of the tub 10 and to form a rod of tobacco 20 beneath the belt 11 and traveling therewith. The machine 1 further includes both a cam compression device 16, which rotates synchronously with the advance of the rod 20 to periodically compress the rod, and which can be supplemented by a checking device 17 for the rod as described in European application EP-A-0,465,414, and a regulation device 14 for the rod of tobacco 20, made up of two dense-end disks 15, preferably of the type described in previously mentioned U.S. Pat. No. 5,003,996, which is located after cam 16. After trimming, the rod 20 continues its path, and is subsequently separated from the porous belt 11, wrapped in a paper covering, and cut into individual cigarettes in a known manner.

Figure 2:
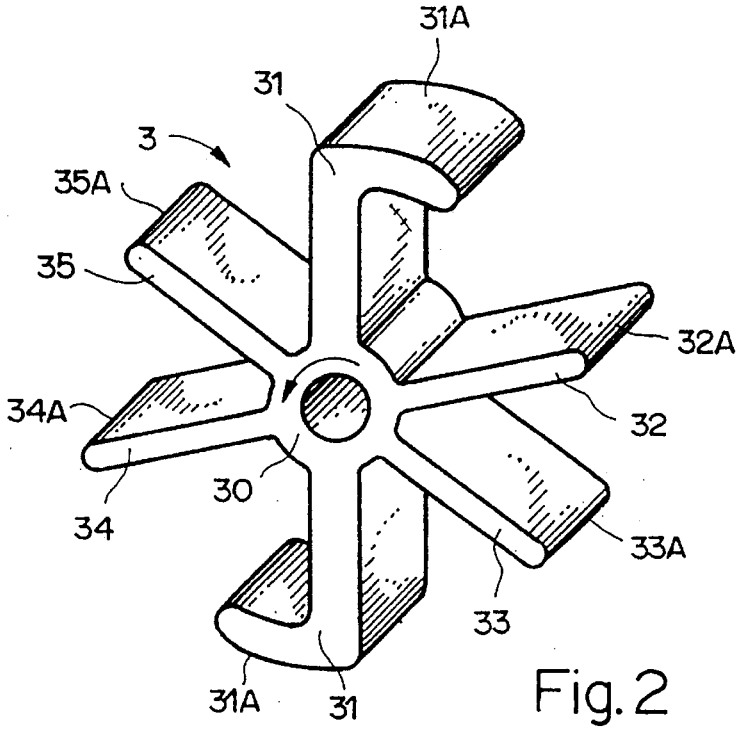
FIG. 2 depicts an embodiment of a compression cam.

In the device according to the invention, the cam 3 of FIG. 2 replaces the cam 16 of FIG. 1 in order to permit the making of a rod of tobacco with variable density. As is seen in FIG. 2, the cam 3 is comprises of a cylindrical core 30 rotating about an axis in the direction indicated and supporting a certain number of blades extending radially starting from the cylindrical core 30. The blades comprise support surfaces disposed in such a way as to exert a compression on the rod of tobacco 20 which travels along an axis perpendicular to the axis of rotation of the cam 3. In the embodiment depicted here, the cam 3 is designed to effect one revolution for a length of tobacco rod equivalent to the length of two cigarettes, that is to say that the outside perimeter or circumference of the cam equals two lengths of the tobacco part of a cigarette. Hence there are two first blades 31, disposed in opposition one relative to the other on each side of the core 30, each of them comprising a support surface 31A. These support surfaces 31A are intended, in view of their relatively great support length, to compress the tobacco at the ends of each cigarette, i.e., the zones 21 of the rod 20 of FIG. 3A, which thus have their density increased. The cam 3 is supplemented by a plurality, e.g., four in the present cases, of other blades 32, 33, 34, and 35, i.e., two for each cigarette length. The blades each have a respective support surface 32A, 33A, 34A, and 35A. The support surface of each blade is, in the case depicted in FIG. 2, appreciably less than the support surfaces 31A. The support surfaces 32A, 33A, 34A, and 35A of this embodiment of the cam are disposed on the same cylindrical peripheral envelope or circumference as the support surfaces 31A, causing these surfaces to press on the rod 20 in an equal manner as surfaces 31A to create compressed zones 22 and 21 of equal increased density.

Figure 3A:
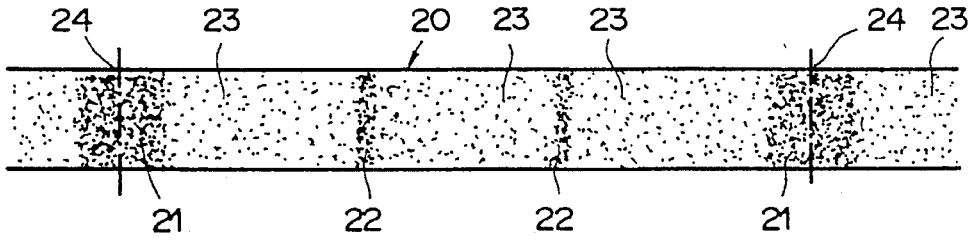
FIG. 3A depicts a portion of a rod of tobacco.

A longitudinal section of a rod 20 obtained with the aid of a cam 3 as described with reference to FIG. 2 above is depicted in FIG. 3A. Distinguished there are zones of increased density 21 having a length equivalent to the length of the support surfaces 31A, as well as zones of increased density 22 which correspond to the passage of the support surfaces 32A and 33A or 34A and 35A, each of these zones being separated by a zone 23 of low density corresponding to the passage of the rod 20 between the support surfaces. During the rest of the manufacturing process, the rod 20 will receive a wrapping of paper and will then be cut at the locations marked 24 in order to form the tobacco part of a cigarette. It is noticed in FIG. 3A that the zones 23 of low tobacco density all have the same length resulting from the position of the blades about the core 30. It would be just as possible to dispose the blades at different relative angles so as to lengthen or shorten, respectively, some of these zones.

Figure 3B:
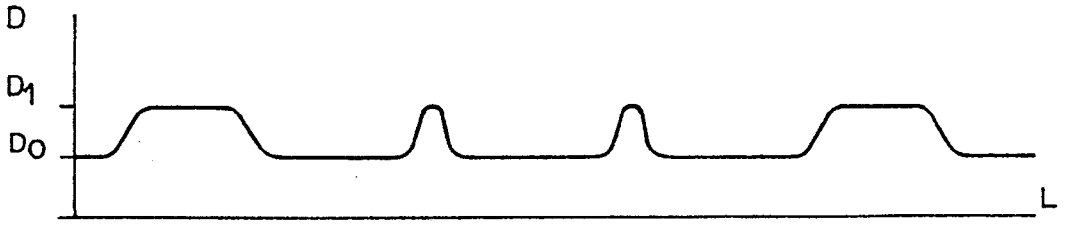
FIG. 3B is a graph depicting the variation in density of the tobacco in the rod of FIG. 3A.

FIG. 3B depicts a curve showing the variation in density D of the tobacco along the rod of FIG. 3A. It is seen that the zones 23 are of low density, value $D_0$, and that the zones 21 are of higher density, value $D_1$.

Figure 4:
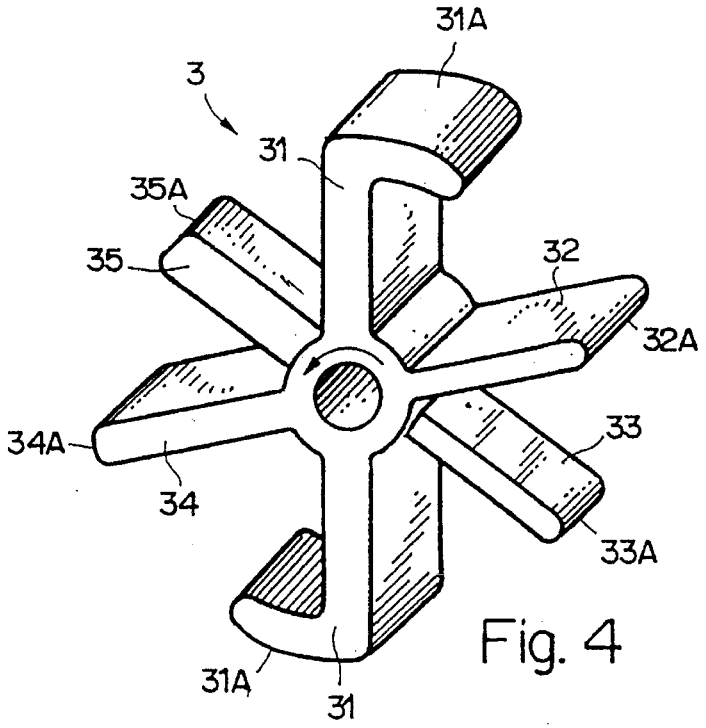
FIG. 4 depicts a compression cam comprising several variations of the compression cam blades.
Figure 5A:
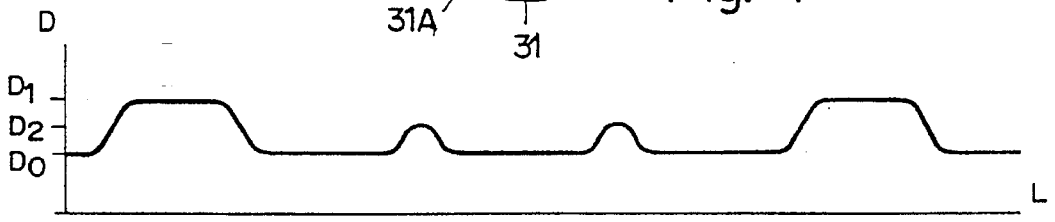
FIGS. 5A, 5B, and 5C are graphs depicting diverse types of variation of the density of tobacco in the rod resulting from the respective cam blades of FIG. 4.

The cam 3 of FIG. 4 is similar to that of FIG. 2, except that the blades 32', 33', 34', and 35' are, by way of example, each formed in a different way, therefore having a different effect on the rod of tobacco. For example, the support surface 32A' of the blade 32' is on a cylindrical peripheral envelope of slightly smaller diameter than that of the cylindrical peripheral envelope of the support surfaces 31A, i.e., blade 32' is shorter than blade 31. If the cam 3 had all its blades 32', 33', 34', and 35' conceived in this way, the compression, or the density, respectively, of the zones 22 of the rod 20 would have a density higher than $D_0$ but lower than $D_1$, i.e., a value $D_2$ as depicted in FIG. 5A. Note that it is also possible to have a support surface 32A' situated at a higher level than that of the support surfaces 31A, thus increasing the density of the zones 22 in such a way that it is higher than of the zones 21.

Another possible variation is shown by the blade 33', the support surface 33A' of which is at the same level as the support surfaces 31A', but the support width along core 30 of which is less than the width of that of the surfaces 31A', or of the rod 20, respectively. By means of a cam equipped with blades of this type, a rod is obtained of which only one central region of the width of zone 22 has a density as depicted in FIG. 3B.

Figure 5B:
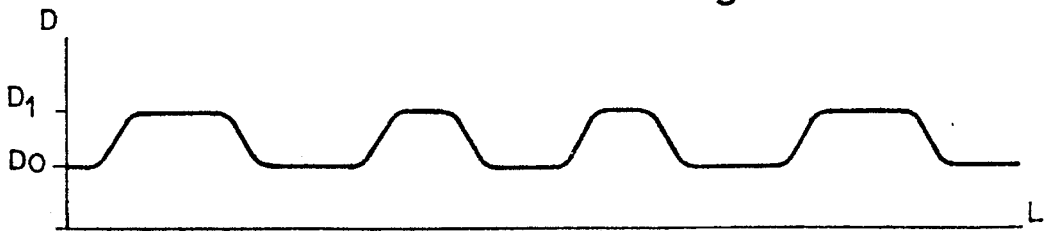

The blades 34' of FIG. 4 differ from the blade 34 of FIG. 2 in that the support length, i.e., the thickness, of the support surface 34A' in FIG. 4 is relatively greater than the support surface 34 of FIG. 2. There is thus obtained a distribution of the densities along the rod as depicted in FIG. 5B, showing that the zones 22 are appreciably longer than in FIG. 3B.

Figure 5C:
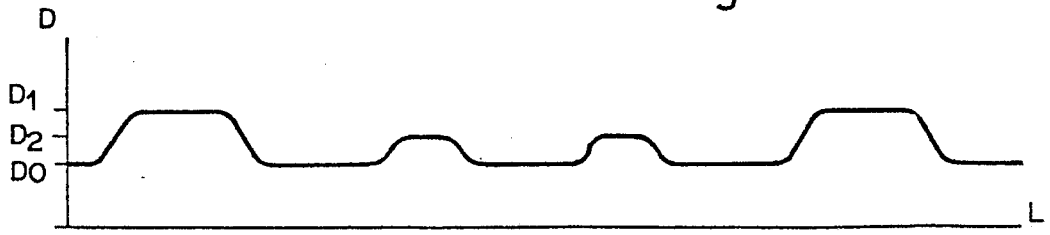

Finally, the blade 35' of FIG. 4 shows a combination of the preceding variations, i.e., having a support surface 35A' situated at a lower level than that of the support surfaces 31A, a greater support length and a smaller support width. Such a cam results in the central portion of the rod having a distribution of density as depicted in FIG. 5C.

It is obvious that a cam as depicted in FIG. 4, comprising such a variety of compression means, will not normally be employed, but which appears here by way of example of the possible compression or density-increasing means. 0n the other hand, a certain number of variations of the cams described above can be employed. First of all, the cam may be dimensioned to effect one revolution per cigarette length or else more than two revolutions per cigarette length. The diameter of the cylindrical envelope of the support surfaces, the number of blades and of support surfaces, as well as the speed of rotation of the cam are chosen accordingly in such a way that the peripheral speed of the support surfaces of the blades corresponds to the speed of longitudinal travel of the rod. Moreover, one can also have intermediate zones of increased density 22 according to a number other than two as in the examples described and depicted wherein the number of blades, or of support surfaces, respectively, is chosen accordingly. In case there is more than one intermediate zone of increased density 22 over the length of a cigarette, it is also possible for the type of compression to be different between these zones. For example, if there are three intermediate zones 22 over a cigarette length—not counting the end zones 21—there may be two lateral zones of high density and of short length, caused by support surfaces similar to the surfaces 32A of FIG. 2, surrounding a third zone, specifically a central zone 22, of slightly lower density and of greater length, but not extending over the whole width of the rod, caused by a support surface similar to the surface 35A' of FIG. 3.

The product produced according to the present invention has intermediate zones or regions which result in a compressibility, preferably measured as stated above, which is equivalent to the compressibility of a conventional cigarette having no compressed density region(s), and preferably a conventional cigarette having a preponderance of non-expanded shreds of tobacco leaf.

Thus, a product of the tobacco industry or a cigarette composed wholly or in part of other raw materials of the tobacco industry than of long shreds of tobacco, i.e., starting from short shreds, from expanded shreds or ribs, if it is manufactured in the way described above, has one or more intermediate zones of higher density, causing its filling and its measured compactness to be better than those of a cigarette not comprising these intermediate zones of higher density. Such a product has an equivalent maintenance and is as pleasant to smoke as an ordinary product.

Many substitutions, modifications and improvements will be apparent to the skilled artisan without departing from the spirit and scope of the present invention as described and defined herein and in the following claims.

We claim:

1. A method of varying the density of a rod of tobacco material comprising the steps of:

providing a rod of tobacco material;

compressing a first end region of a segment of the rod to increase the density;

compressing a first intermediate region of the rod segment spaced apart from the first end region; and compressing a second end region of the rod segment, spaced apart from the first intermediate region the intermediate region located between the first and second end regions, the first and second end regions defining a segment length for a subsequently formed cigarette rod cutting the rod at the first end region and second end region to form the cigarette rod.

2. The method according to claim 1, further comprising periodically repeating said steps of compressing the first end region, the intermediate region and the second end region along the rod of tobacco material to vary the density of successive segment lengths.

3. The method according to claim 1, wherein said step of compressing a second end region of one segment further comprises compressing a first end region of another segment adjacent the one segment.

4. The method according to claim 1, wherein said steps of compressing the first and second end regions of the segment comprises compressing the first and second regions to approximately the same density.

5. The method according to claim 1, wherein said step of compressing the first intermediate region comprises compressing the first intermediate region to approximately the same density as at least one of the first and second end regions.

6. The method according to claim 1, wherein said step of compressing the first intermediate region comprises compressing the first intermediate region to a greater density than at least one of the first and second end regions.

7. The method according to claim 1, wherein said step of compressing the first intermediate region comprises compressing the first intermediate region to a lesser density than at least one of the first and second end regions.

8. The method according to claim 1, wherein said step of compressing the first intermediate region comprises compressing a first intermediate region having a shorter width perpendicular to a longitudinal axis of the rod than at least one of the first and second end regions.

9. The method according to claim 1, wherein said step of compressing the first intermediate region comprises compressing a first intermediate region having a width perpendicular to a longitudinal axis of the rod which is approximately equal to a respective width of at least one of the first and second end regions.

10. The method according to claim 1, wherein said steps of compressing the first and second end regions comprises compressing first and second regions having approximately equal widths perpendicular to a longitudinal axis of the rod.

11. The method according to claim 1, wherein said step of compressing the first intermediate region comprises compressing a first intermediate region having a length parallel with a longitudinal axis of the rod which is less than at least one of the end regions.

12. The method according to claim 11, wherein said step of compressing the first intermediate region comprises compressing a first intermediate region having a length parallel with a longitudinal axis of the rod which is approximately equal to at least one of the end regions.

13. The method according to claim 1, further comprising the step of compressing a second intermediate region located between the first and second regions.

14. The method according to claim 13, wherein said step of compressing the second intermediate region comprises compressing the second intermediate region to approximately the same density as at least one of the first and second end regions.

15. The method according to claim 13, wherein said step of compressing the second intermediate region comprises compressing the second intermediate region to a greater density than at least one of the first and second end regions.

16. The method according to claim 13, wherein said step of compressing the second intermediate region comprises compressing the second intermediate region to a lesser density than at least one of the first and second end regions.

17. The method according to claim 13, wherein said step of compressing the second intermediate region comprises compressing a second intermediate region having a shorter width perpendicular to a longitudinal axis of the rod than at least one of the first and second end regions.

18. The method according to claim 13, wherein said step of compressing the second intermediate region comprises compressing a second intermediate region having a width perpendicular to a longitudinal axis of the rod which is approximately equal to a respective width of at least one of the first and second end regions.

19. The method according to claim 13, wherein said steps of compressing the first and second end regions comprises compressing first and second regions having approximately equal widths perpendicular to a longitudinal axis of the rod.

20. The method according to claim 13, wherein said step of compressing the second intermediate region comprises compressing a first intermediate region having a length parallel with a longitudinal axis of the rod which is less than at least one of the end regions.

21. The method according to claim 13, wherein said step of compressing the second intermediate region comprises compressing a first intermediate region having a length parallel with a longitudinal axis of the rod which is approximately equal to at least one of the end regions.

22. The method according to claim 13, further comprising compressing a third intermediate region between the first and second intermediate regions.

23. The method according to claim 22, wherein said step of compressing the third intermediate region comprises compressing a third intermediate region less densely than the first and second intermediate regions.

24. The method according to claim 23, wherein said step of compressing the third intermediate region comprises compressing a third intermediate region having a greater length parallel to a longitudinal axis of the rod than the first and second intermediate regions.

25. The method according to claim 23, wherein said step of compressing the third intermediate region comprises compressing a third intermediate region having a smaller width perpendicular to a longitudinal axis of the rod than the first and second intermediate regions.

26. A tobacco article comprising:

a rod segment of tobacco material, the rod comprising a first end region, an oppositely located second end region and an intermediate region located between and spaced apart from said first and second end regions;

said first and second end regions and said intermediate region having greater respective densities of cam compressed tobacco material than tobacco material located between said regions.

27. The tobacco article according to claim 26, wherein said first and second end regions have approximately equal respective densities.

28. The tobacco article according to claim 26, wherein said first intermediate region has a density which is approximately equal to at least one of said first and second end regions.

29. The tobacco article according to claim 26, wherein said first intermediate region has a greater density than at least one of said first and second end regions.

30. The tobacco article according to claim 26, wherein said first intermediate region has a density which is less than at least one of said first and second end regions.

31. The tobacco article according to claim 26, wherein said first intermediate region has a density which is approximately equal to at least one of said first and second end regions.

32. The tobacco article according to claim 26, wherein said first and second end regions have approximately equal widths across a longitudinal axis of said rod segment.

33. The tobacco article according to claim 26, wherein said first intermediate region has a width perpendicular to a longitudinal axis of said rod which is approximately equal to at least one of said first and second end regions.

34. The tobacco article according to claim 26, wherein said first intermediate region has a width perpendicular to a longitudinal axis of said rod which is less than at least one of said first and second regions.

35. The tobacco article according to claim 26, wherein said first intermediate region has a length parallel to a longitudinal axis of said rod segment which is approximately equal to at least one of said first and second end regions.

36. The tobacco article according to claim 26, wherein said first intermediate region has a length parallel to a longitudinal axis of said rod segment which is less than at least one of said first and second end regions.

37. The tobacco article according to claim 37 further comprising a second intermediate region located between said first and second end regions, said second intermediate region having a greater respective density of compressed tobacco material than tobacco material located between said regions.

38. The tobacco article according to claim 37, wherein said second intermediate region has a density which is approximately equal to at least one of said first and second end regions.

39. The tobacco article according to claim 37, wherein said second intermediate region has a greater density than at least one of said first and second end regions.

40. The tobacco article according to claim 37, wherein said second intermediate region has a density which is less than at least one of said first and second end regions.

41. The tobacco article according to claim 37, wherein said second intermediate region has a density which is approximately equal to at least one of said first and second end regions.

42. The tobacco article according to claim 37, wherein said first and second end regions have approximately equal widths perpendicular to a longitudinal axis of said rod segment.

43. The tobacco article according to claim 37, wherein said second intermediate region has a width perpendicular to a longitudinal axis of said rod which is approximately equal to at least one of said first and second end regions.

44. The tobacco article according to claim 37, wherein said second intermediate region has a width perpendicular to a longitudinal axis of said rod which is less than at least one of said first and second regions.

45. The tobacco article according to claim 37, wherein said second intermediate region has a length parallel to a longitudinal axis of said rod segment which is approximately equal to at least one of said first and second end regions.

46. The tobacco article according to claim 37, wherein said second intermediate region has a length parallel to a longitudinal axis of said rod segment which is less than at least one of said first and second end regions.

47. The tobacco article according to claim 37, further comprising a third intermediate region located between said first and second intermediate regions, said third intermediate region having a greater respective density of compressed tobacco material than tobacco material located between said regions.

48. The tobacco article according to claim 47, wherein said third intermediate region has a lesser density than said first and second intermediate regions.

49. The tobacco article according to claim 47, wherein said third intermediate region is longer with respect to the longitudinal axis of said rod than said first and second intermediate regions.

50. The tobacco article according to claim 48, wherein said third intermediate region has a smaller width perpendicular to the longitudinal axis of said rod than said first and second intermediate regions.

* * * * *